US009844237B2

(12) United States Patent
Cristodero et al.

(10) Patent No.: US 9,844,237 B2
(45) Date of Patent: Dec. 19, 2017

(54) REVERSIBLE BOWTIE ASSEMBLY

(71) Applicant: Brooks Brothers Group, Inc., New York, NY (US)

(72) Inventors: Richard Cristodero, New York, NY (US); Adriana Lucin, New York, NY (US); Asher Von Stein, New York, NY (US)

(73) Assignee: Brooks Brothers Group, Inc., New York, NY (US)

( * ) Notice: Subject to any disclaimer, the term of this patent is extended or adjusted under 35 U.S.C. 154(b) by 635 days.

(21) Appl. No.: 14/047,305

(22) Filed: Oct. 7, 2013

(65) Prior Publication Data

US 2015/0096100 A1 Apr. 9, 2015

(51) Int. Cl.

| | |
|---|---|
| ***A41D 25/02*** | (2006.01) |
| ***A41D 25/04*** | (2006.01) |
| ***A41D 25/08*** | (2006.01) |
| ***A41D 25/16*** | (2006.01) |
| ***A41D 25/06*** | (2006.01) |
| ***A41D 25/00*** | (2006.01) |

(52) U.S. Cl.

CPC ..... *A41D 25/06* (2013.01); *A41D 25/005* (2013.01); *A41D 25/04* (2013.01)

(58) Field of Classification Search

CPC ..... A41D 25/06; A41D 25/005; A41D 25/10; A41D 25/14; A41D 25/08; A41D 25/02; A41D 25/025; A41D 25/04; A41F 1/004; A41F 9/00

USPC ..... 2/145, 151, 154–157, 338, 339; 24/50, 24/54, 56, 57, 93, 342.1, 379.1, 378.1, 24/578.11, 578.12, 578.13

See application file for complete search history.

(56) References Cited

U.S. PATENT DOCUMENTS

| | | | | |
|---|---|---|---|---|
| 1,446,843 A | | 2/1923 | Dorward | |
| 1,456,757 A | | 5/1923 | Berkson | |
| 1,539,913 A | * | 6/1925 | Reinhart | A41D 25/02 2/151 |
| 1,737,072 A | | 11/1929 | Blach | |
| 1,737,882 A | * | 12/1929 | Hatch | A41D 1/08 2/227 |
| 1,759,007 A | | 5/1930 | Halpern et al. | |
| 2,020,507 A | * | 11/1935 | Keys | A41D 25/06 24/198 |
| 2,083,106 A | | 6/1937 | Wolfson | |

(Continued)

FOREIGN PATENT DOCUMENTS

| | | | | |
|---|---|---|---|---|
| EP | 0672358 A1 | | 9/1995 | |
| FR | 1262296 A | * | 5/1961 | A41D 25/06 |

OTHER PUBLICATIONS

English machine translation of FR 1262296 A; via Espacenet.com. Translation performed Dec. 14, 2015.*

(Continued)

*Primary Examiner* — Jameson Collier

(74) *Attorney, Agent, or Firm* — Baker & McKenzie LLP

(57) ABSTRACT

A bowtie module is described having first and second modules, each having a first and second side and a first and second end. A connector element is disposed on a first side of the first module and another connector element is disposed on the second side of the first module. The second module includes a hole defined therethrough for receiving one of the connector elements, thereby connecting the first module to the second module.

19 Claims, 5 Drawing Sheets

(56) References Cited

U.S. PATENT DOCUMENTS

| | | | | | |
|---|---|---|---|---|---|
| 2,084,720 | A * | 6/1937 | Alexandre | A41F 9/025 | 2/237 |
| 2,125,715 | A | 8/1938 | Goldenberg | | |
| 2,139,510 | A | 12/1938 | Mayer | | |
| 2,208,026 | A | 7/1940 | Goldenberg | | |
| 2,270,521 | A | 1/1942 | Gray | | |
| 2,390,465 | A * | 12/1945 | Russo | A41C 3/00 | 450/58 |
| 2,625,687 | A * | 1/1953 | Sol | A41D 25/06 | 2/151 |
| 2,970,597 | A * | 2/1961 | Milton | A41C 3/02 | 24/442 |
| D242,954 | S | 1/1977 | Rand | | |
| 5,794,572 | A | 8/1998 | Saunders et al. | | |
| D524,184 | S | 7/2006 | Watanabe | | |
| 7,698,748 | B2 | 4/2010 | Kim | | |
| 7,757,306 | B2 * | 7/2010 | Mattioli | A41D 25/001 | 2/144 |
| D696,407 | S | 12/2013 | Herman et al. | | |
| D705,428 | S | 5/2014 | Cheney et al. | | |
| D706,520 | S | 6/2014 | Kim | | |
| D724,816 | S * | 3/2015 | Cristodero | D2/606 | |
| 2008/0172772 | A1 * | 7/2008 | Kim | A41D 25/06 | 2/144 |
| 2014/0366243 | A1 * | 12/2014 | Ontiveros | A41D 25/06 | 2/154 |
| 2015/0052659 | A1 * | 2/2015 | Talic | A41D 25/005 | 2/156 |
| 2015/0096101 | A1 * | 4/2015 | Etheridge | A41D 25/06 | 2/144 |
| 2015/0216243 | A1 * | 8/2015 | Graham | A41D 25/003 | 2/151 |

OTHER PUBLICATIONS http://www.porhomme.com/2011 /05/dolbeau-diamond-tip-wool-reversible-bowtie/.

http://www.whiskeycotton.com/bow-ties/savannah-bow-tie.html.

http://casartcoverings.com/casartblog/2011/08/page/3/.

http://www.styleforum.net/t/71025/fs-bow-ties-carrot-gibbs-15-each.

Brooks Brothers Reversible Bow Tie, [site visited Dec. 3, 2014]. Available from internet, <URL: http://www.brooksbrothers.com/Fox-with-Dog-Reversible-Bow-Tie/MA01789,default,pd.html?dwvar_MA01789_Color=BRWN&contentpos=20&cgid=0210.

Carrot Gibbs Bow Ties, available May 24, 2013, [online], [site visited Dec. 3, 2014]. Available from internet, <URL: http://www.completesoutherngentleman.com/carrot-gibbs-bow-ties/.

Redcrow Neckwear, available May 9, 2011, [online], [site visited Dec. 3, 2014]. Available from internet, <URL: http://redcrowqualitygoods.blogspot.com/20 11 /05/redcrow-neckwear.html.

Handmade bow ties, available Oct. 4, 2012, [online], [site visited Dec. 3, 2014]. Available from internet, <URL: http://www.systematicdeparturefromnormality.com/2012/1 0/handmade-bow-ties-weeping.html.

Silk bow tie, available Dec. 17, 2013, [online], [site visited Dec. 3, 2014]. Available from internet, <URL: http://pinoportland.com/product!dusk-raw-silk-bow-tie/.

* cited by examiner

REVERSIBLE BOWTIE ASSEMBLY

I. BACKGROUND

A. Field of Invention

The present invention generally relates to neckwear. More particularly, the present invention relates to neckties and or bowties which are modular and reversible.

B. Description of the Related Art

Neckties and or bowties are well-known, as is the ability to reverse same. A bowtie may comprise a strip of material having a length that ties around a collar in a symmetrical manner forming two opposite loops, i.e., bow. The strip of material may have fixed or adjustable length. Opposing ends of the material comprise geometry, typically mirror image of each, and commonly in form of a thistle or bat wing. Also known are ready-tied bow ties, which may be available in a pre-tied form and capable of being adjusted for length U.S. Pat. No. 1,456,757 discloses a reversible necktie that comprises two ready-made bows that can be selectively rotated within a loop to display two neckties in one. In an embodiment, the necktie may be adjustable by a hoop which has a buckle tensioned at one end and a hook at an opposing end for securing to a ring.

U.S. Pat. No. 2,139,510 discloses a fastener for an adjustable necktie that connects two ends, one end which is adjustable and the other end fixed. In an embodiment, a fastener connects to predetermined slits for adjusting the length of one end. A hoop is disposed therein and connects to a hook formed on the second fixed end.

EP 0672358 discloses a modular necktie. In an embodiment, the necktie may comprise a collar that consists of two ends that has rapid, adjustable fasteners such as VELCRO®, a type of hook-and-loop fastener, for example.

U.S. Pat. No. 7,698,748 discloses a reversible necktie. In an embodiment, a necktie comprises a strip of material. Opposing sides comprise different patterns that alternate at a neck band region providing a wearer with two tie options.

A bowtie is known that is available by Carrot & Gibbs (Boulder, Colo., style BT12S-ASST), wherein two modules are provided that are identical with exception to connection means. A first module has male connectivity means that is limited to four buttons disposed in series on a first side at a connecting end (i.e., the end opposite bow geometry) and no connecting means are provided on opposite side. Second module has female connectivity means limited to four holes that correspond to said four buttons.

None of aforesaid references provide a bowtie module having male and female connectivity means on a same and or opposing side, such that a second module having same connectivity means on at least one side may allow for multiple connection options and provide for a bowtie that is modular, reversible, and interchangeable as disclosed by the instant invention.

II. SUMMARY

The current invention is a modular bowtie that provides for reversibility including numerous configurations thereto.

The purpose or object of the present invention is to provide a first bowtie module configured to connect to a second bowtie module such that the combination of which forms a single material that is adjustable and reversible.

It is a further object of the present invention to provide a first bowtie module configured to connect to a second bowtie module such that the surface design of either module may contrast, be identical, or complimentary such that the combination of said forms a single material having an intentional design, such as a word, phrase or image that may be altered by changing modules or alternating connectivity. It is a further object of the instant invention that either module of a bowtie may be replaced individually by another module such that numerous bowties may be configured or a single module may replace an identical and or damaged module without need to purchase an entirely new bowtie.

III. BRIEF DESCRIPTION OF THE DRAWINGS

The invention may take physical form in certain parts and arrangement of parts, some embodiments of which will be described in the specification and illustrated in accompanying drawings which form a part hereof, wherein.

Figure 2A:
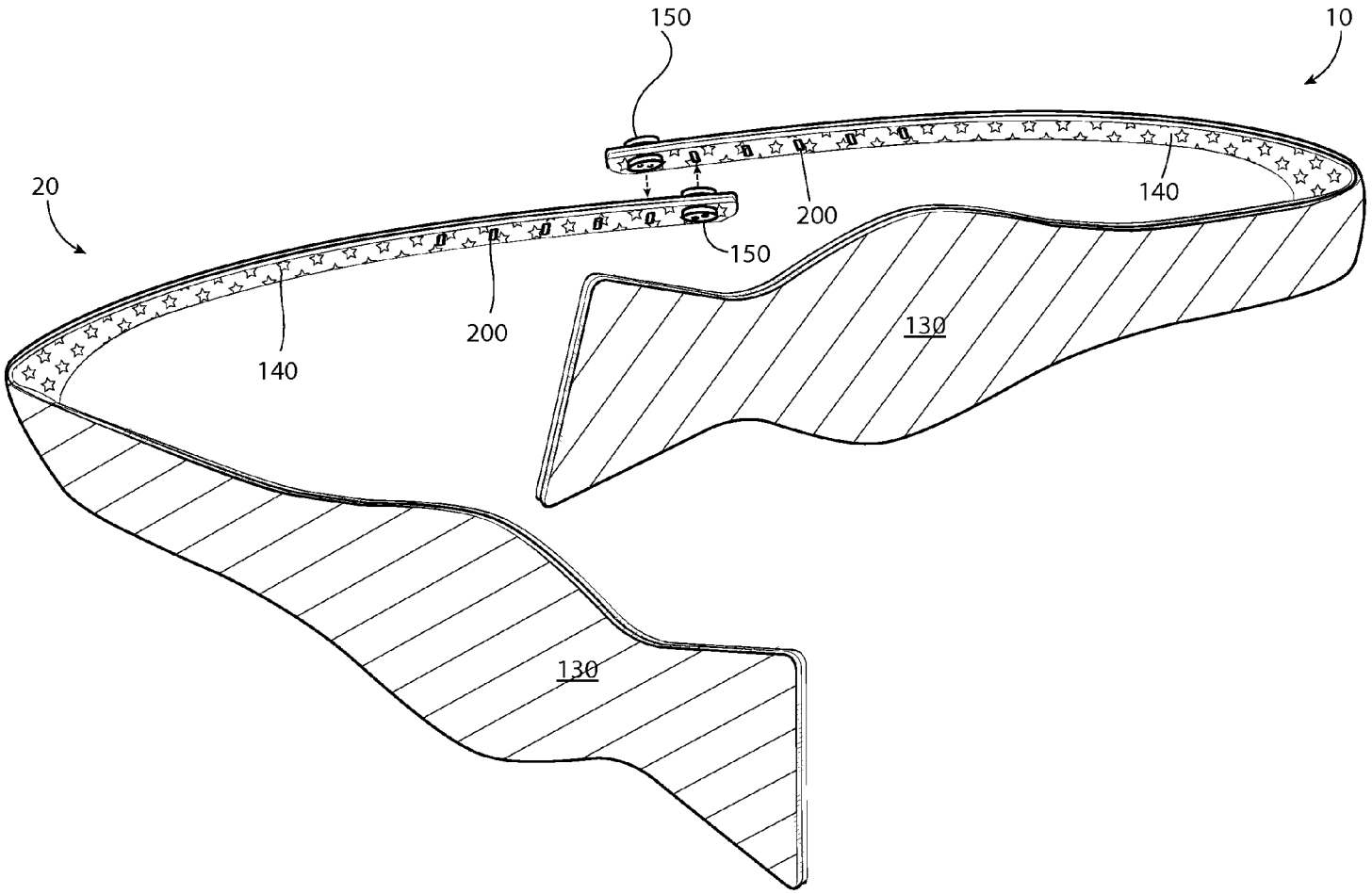
FIG. 2A is an embodiment of two mirror image bowtie modules according to the invention, providing how connecting means of modules may join and or connect in a joining position, wherein opposing sides of the modules have contrasting surface design. Modules may connect to provide an adjustable length, and as shown, the connection provides a length, with connection indicated by arrows.
Figure 2B:
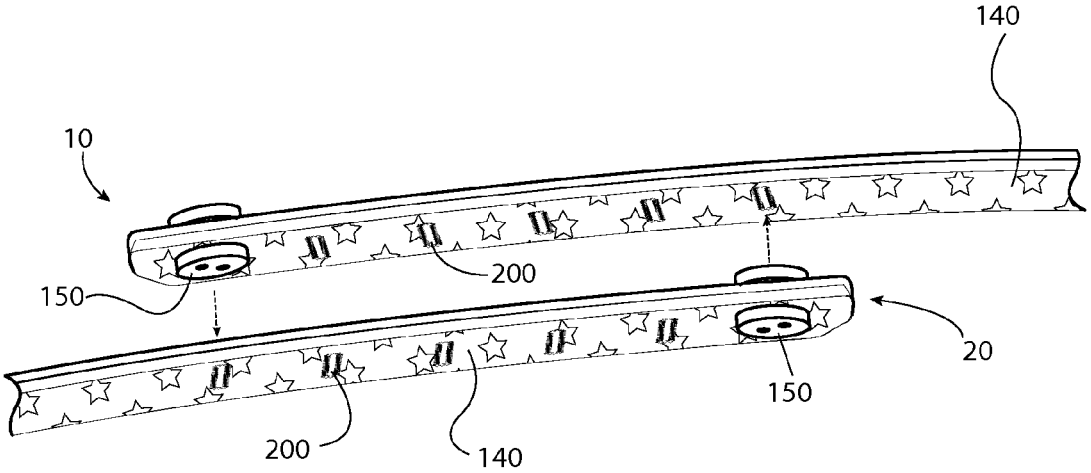
Figure 3A:
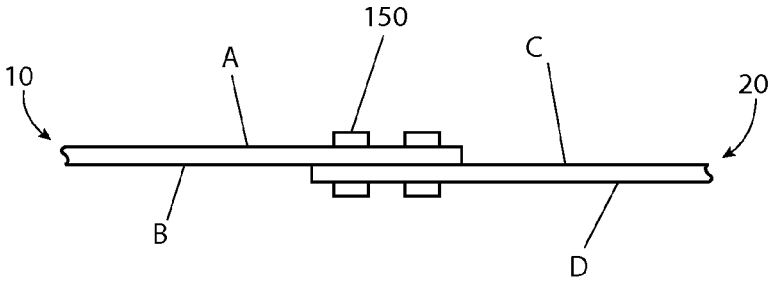
Figure 3B:
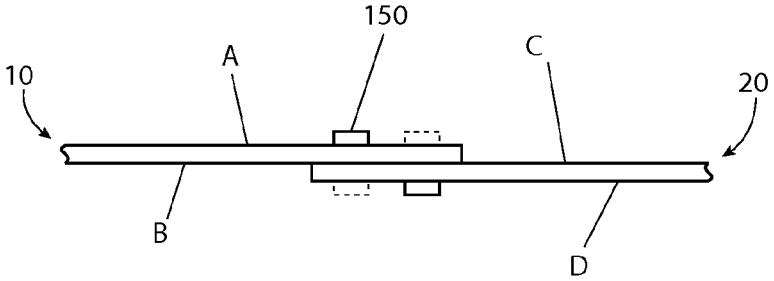
Figure 4A:
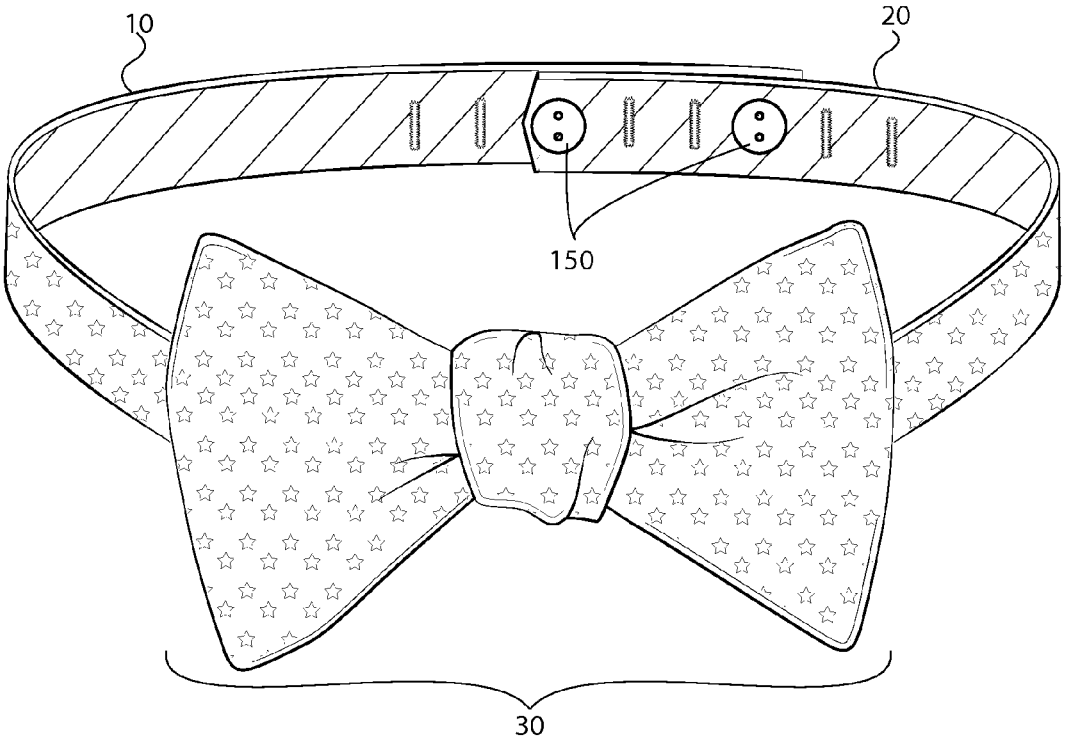
Figure 4B:
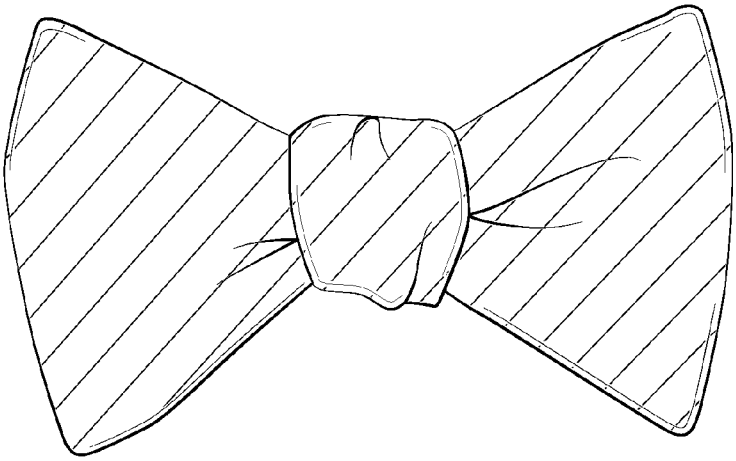
Figure 4C:
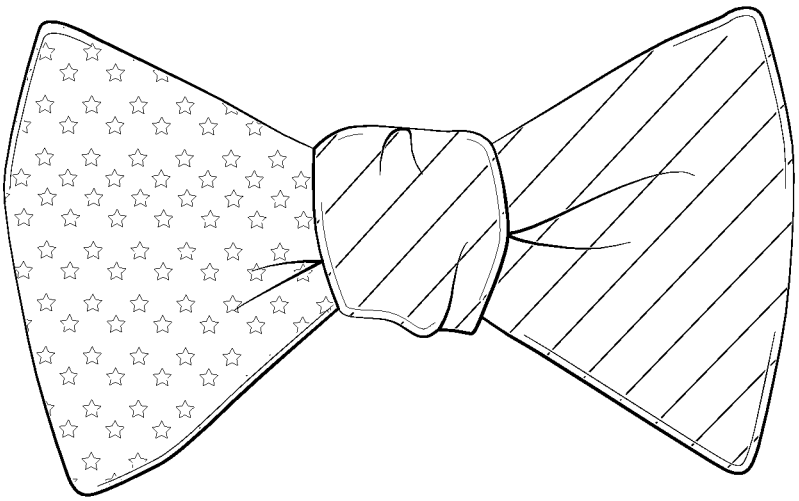
Figure 4D:
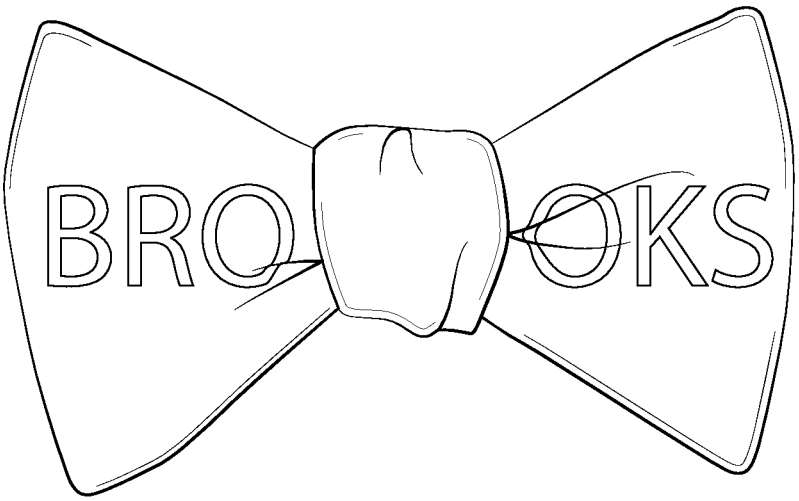

FIG. 2B provides a cut away of the second ends of two modules according to FIG. 2A, whereby overall length is minimized according to connecting means;

FIG. 3A provides a cut away of the second ends of two modules according to the instant invention, wherein sides are identified using letters A, B, C and D to provide explanation as to embodiments of how connecting means of modules may join and or connect in a variety of modes, i.e., joining position;

FIG. 3B provides a cut away of the second ends of two modules according to the instant invention, as shown in FIG. 3A, however in an alternate embodiment wherein buttons may be optional as shown in broken lines, and providing embodiments of how connecting means of modules may join and or connect in a variety of joining position, i.e. modes;

FIG. 4A provides an embodiment of a tied bowtie, according to FIG. 2A, wherein two modules have same surface on respective sides and the outward appearing bow arrangement is a mode of all stars;

FIG. 4B provides an embodiment of a tied bowtie, according to FIG. 4A, when reversing orientation of the material, i.e., flipping the length, such that the outward appearing tied bowtie is arranged in a mode of all stripes;

FIG. 4C provides an embodiment of a tied bowtie, wherein the connectivity side of either module is reversed, and the tied bowtie is arranged in a mode that displays an intentional design of stars and stripes; and FIG. 4D provides an embodiment of a tied bowtie, wherein two modules comprise contributory and or complimentary surface features on a side such that upon connecting same and tying thereto forms an intentional design (in this example the word "Brooks").

IV. DETAILED DESCRIPTION OF THE INVENTION

The instant invention provides a bowtie module that has connecting means on either side so that a single module may connect with either and or both sides of another module, the combination of which may provide a single bowtie with several modes of orientations, having several arrangements thereto.

Figure 1:
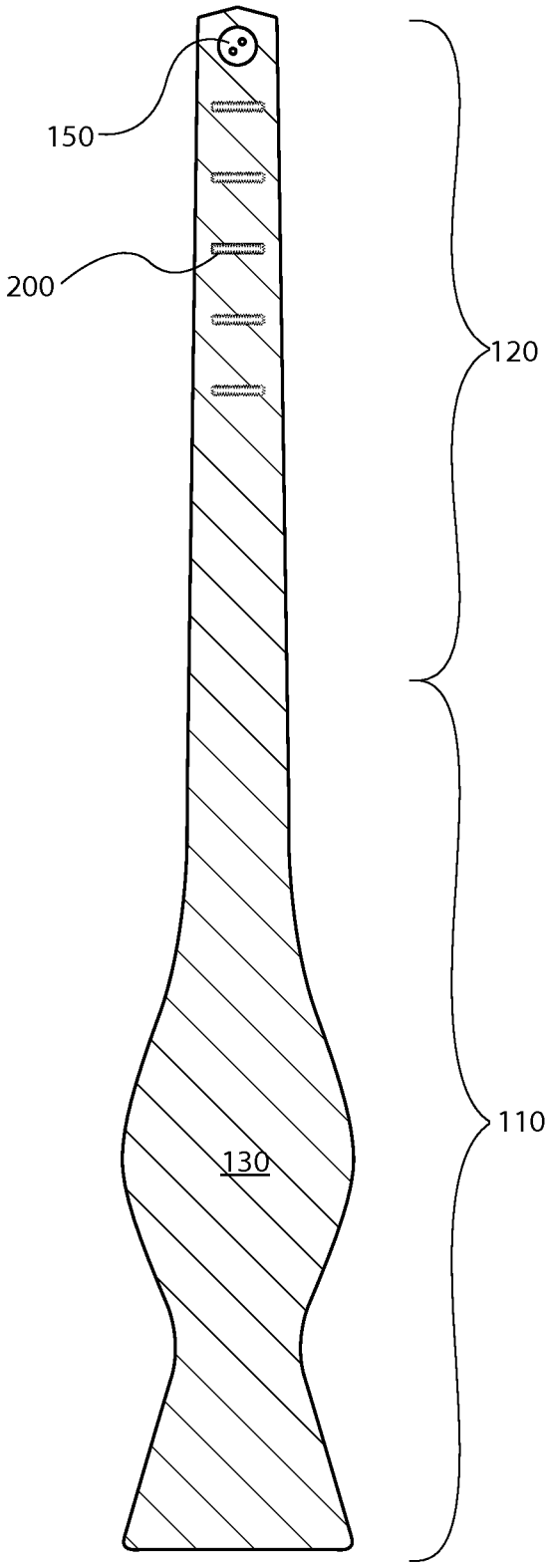
FIG. 1 is an embodiment of a bowtie module showing a first side according to the invention having a striped surface design, wherein an embodiment may include opposite side (i.e., second side) being a mirror image of first side as shown, or have a contrasting and or complimentary surface design, with or without a button thereon.

FIG. 1 shows a first side 130 of a single bowtie module. As shown, the module comprises two ends (120, 110) and has a striped pattern. The striped pattern is used only as reference as a module may comprise any surface pattern, color, design or be otherwise void thereof. The opposite side of the module (140) may be a mirror image of the first side as shown and or may likewise comprise any surface pattern, color, design or be otherwise void thereof.

The first end 110 of said first side 130 comprises a geometrical form, for combining with a first end of another module to form a bow 30. The second end 120 of said first side 130 comprises connective means and or means to connect and or join to a second end of another module to form a single material unit having a length, to be wrapped about an object, for example a neck. Means to connect comprise both male and female connectivity elements. As shown, the male element comprises a button 150 and the female element comprises hole 200. Button 150 can be disposed in proximity to a hole 200, and or holes, in series (as shown) wherein said button 150 is distal to a hole 200 followed by a series of additional holes 200, which may be used to adjust overall length of material when two modules are combined (as shown in FIGS. 2A and 2B, for example). Also, an arrangement may comprise alternating button 150 and hole 200 configurations, in a series, including variations thereof within the scope of the invention.

In an embodiment where length of the overall material may be fixed, there may be at least one female component (i.e., hole 200) and at least one male component (i.e., button 150) disposed in any proximity such that its configuration correlates to configuration of another module, which may be its mirror image. In an embodiment, arrangement of connecting means can provide at least about four connectivity modes and or ways a length of material may exist when two modules are combined, and provide for at least about eight corresponding arrangements thereto that includes when the material is flipped and bow 30 reversed, which should be apparent based on disclosure herein. Said means to connect and or join second end 120 may be disposed on at least one side of a module, or both, and configured such that the at least one side is capable of joining and or connecting to either, and or both, sides of a second end of another module. Said another module may be a mirror image of the module disclosed in FIG. 1.

FIG. 2A is an embodiment of two mirror image bowtie modules according to the invention. As shown, first side 130 of module 20 comprises a configuration designed to selectively connect with second side 140 of first module 10 having a complimentary configuration. FIG. 2A provides an embodiment where the modules are mirror images of each. Here, first module 10 has a first side 130 having a striped pattern disposed thereon. The second side 140 of the first module 10 has a stars pattern disposed thereon. As shown, a button 150 on the second side 140 of first module 10 threads hole 200 entering the first side 130 of second module 20 as indicated by arrow. Likewise, button 150 on first side 130 of second module 20 threads hole 200, entering from the second side 140 of the first module as indicated by arrow. In the embodiment, the connection as shown provides a maximum adjustable length.

An embodiment includes providing a bowtie that is adjustable in length, thereby conforming to the width and or size of a wrapped material, like a neck, for instance. FIG. 2B provides a cut away of two modules according to the instant invention, providing how connecting means of modules are complimentary and may connect in a joining position, whereby overall length is minimized according to proposed connecting means. Based on arrangement of male (i.e., button) and female (i.e., hole) component(s), as disclosed, the second ends 120 of respective modules may connect as shown. For example, button 150 of module 10, disposed on second side 140 threads hole 200 of module 20 that is the farthest from button 150 disposed on second module 20 as indicated by arrow; and likewise, button 150 of module 20 threads hole 200 of module 10 that is farthest from button 150 disposed on first module 10 and entering through the second side 140.

A module may have universal connecting means on at least one side or both, such that at least about four (4) combinations may be contemplated when connecting two modules. FIG. 3A provides a cut away of the second ends of two modules according to the instant invention, providing an embodiment of how connecting means of modules may join and or connect in a variety of joining position. For example, if the second end 120 of the first side 130 of a first bow-tie module 10 is referred to as "A"; the second end 120 of the second side 140 of the first bow-tie module 10 is referred to as "B"; the second end 120 of the first side 130 of a second bow-tie module 20 is referred to as "C"; and the second end 120 of the second side 140 of the second bow-tie module 20 is referred to as "D"; combinations include A:C, A:D, B:C (as shown), and B:D. It is an embodiment of the invention for only one side of a module to have a button. In this embodiment, it is contemplated that about at least about four connectivity modes the two modules may connect, and provide for about at least about eight arrangements thereto that includes when the material is flipped and either mode reversed. It is an object of the invention that modules may be offered at the marketplace individually such that an individual module is capable of combining to another module having similar connectivity, and may be used to form a completely new bowtie. The module may have connectivity on either and or both sides and the surface and or design thereto may contrast or be same as opposing side. Furthermore, in event a side of a module is damaged, it may be flipped so the damaged portion is hidden. If both sides of a module is damaged, a new module may be used to form a completely new bowtie, and so on.

As apparent by disclosure herein, there could be several arrangements and or connectivity modes of how a second end of a first module and or second end of a second module may be configured and or combine to another module. FIG. 3B provides an embodiment of the cut away as shown in FIG. 3A, wherein buttons may be removed as indicated with buttons in broken lines. As shown, the second end 120 of the first side 130 of a second bowtie module 20 (i.e., "C") has a button as does the second end 120 of the second side 140 of the first bowtie module 10 (i.e., "B"). In this embodiment, overall length may still be adjustable, however, combinations may be limited to B:C, as shown in FIG. 3A. Here, it is contemplated that the connection, whereby each module has connectivity on a single side, that there may be one way the two may connect, and the complete material can be flipped to be reversible. Optionally, in the embodiment wherein module 10 has the same configuration on both sides, i.e., the second end 120 of the second side 140 of the first bowtie module 10 (i.e., "B") has a button as does the second end 120 of the first side 130 of the first bow-tie module 10 (i.e., "A") and the second end 120 of the first side 130 of a second bowtie module 20 (i.e., "C") has a button overall length may still be adjustable, however, combinations may include B:C (as shown) and A:C. Here, it is contemplated the mirror-image-side of module 10 may connect to either side of module 20, providing for two different connectivity modes, and at least about four (4) arrangements thereto that includes when the material is flipped and the tie is reversible.

FIG. 4A provides an embodiment of a tied bowtie, according to FIG. 2A, wherein two modules have same surface on respective sides and the outward appearing bow 30 has an intentional pattern that is of all stars. As shown, module 10 and module 20 are mirror images such that the surfaces are alike. In this embodiment, the material when untied may be flipped and the bow 30 may be reversible, as shown in FIG. 4B having an intentional pattern of all stripes. Because an embodiment of the instant invention includes modules having connective on either sides, and or both, the display as shown in FIG. 4C of an intentional pattern of stars and stripes may be attained by reversing only module 20 of FIG. 4A. It should be clear that the bow 30 may also provide for the combination of stripes and stars, for example if the orientation of module 10 of FIG. 4A was reversed.

FIG. 4D provides another embodiment wherein a portion of first ends 110 of a first side 130 of a first module 10 and a first side 130 of a second module 20 comprises an arrangement of letters such that the tying of the modules to a bow 30 displays an intentional pattern that comprises a word. As shown, letters "BRO" are disposed on said first module and "OKS" are disposed on said second module, which provide for an abbreviation of applicant named herein. It is included in this disclosure that other symbols, characters, and or phrases can be disposed on a portion of a module and altered simply by changing modules or reorientation the connection of two modules to form another intentional pattern. For example, said second module can be replaced with a module that has "NKS" and the tied bow could reveal the word "BRONKS". Various changes and modifications may be made without departing from the spirit and scope of the Invention and it is intended that such obvious changes and modifications be embraced by the annexed claims.

Having thus described the invention, what is claimed as new and desired to be secured by Letters Patent is:

1. A bowtie assembly, comprising:

a first module including a first end portion and a second end portion, a width of the first end portion being greater than a width of the second end portion;

a second module including a first end portion and a second end portion, a width of the first end portion of the second module being greater than a width of the second end portion of the second module;

a first male connector disposed at the second end portion of the first module;

a second male connector disposed at the second end portion of the first module, the second male connecter being disposed on an opposite surface of the second end portion of the first module from the first male connector;

a first female connector disposed at the second end portion of the second module, the first female connector is operable to couple with at least one of the first and second male connectors such that the first and second modules are configured to combine to provide a bowtie, wherein for each of the first and second modules:

the first end portion includes a wide portion spaced away from an end of the first end portion, the first end portion includes a narrow portion disposed between the wide portion and the end of the first portion, a widest width of the wide portion is greater than a width of the narrow portion, and a width of the end of the first end portion is greater than the width of the narrow portion.

2. The bowtie assembly of claim 1, wherein at least one of the first and second male connectors includes a button.

3. The bowtie assembly of claim 1, wherein the first female connector includes a hole defined through the second end portion of the second module.

4. The bowtie assembly of claim 3, wherein the first female connector includes a plurality of holes defined through the second end portion of the second module.

5. The bowtie assembly of claim 4, wherein the at least one of the first and second male connectors is operable to couple to any of the plurality of holes defined in the second end portion of the second module to provide a bowtie of adjustable length.

6. The bowtie assembly of claim 1, wherein a first side of the first module includes a first surface design, and a second side of the first module includes a second surface design different from the first surface design.

7. The bowtie assembly of claim 6, wherein a first side of the second module includes the first surface design, and a second side of the second module includes the second surface design.

8. The bowtie assembly of claim 7, wherein the first and second surface designs are configured to combine to form a word or phrase.

9. The bowtie assembly of claim 1, further comprising a third male connector disposed at the second end portion of the second module, a fourth male connector disposed at the second end portion of the second module, the fourth male connecter being disposed on an opposite surface of the second end portion of the second module from the third male connector, and a second female connector disposed at the second end portion of the second module.

10. The bowtie assembly of claim 1, wherein the second module is distinct from the first module.

11. A bowtie assembly, comprising:

a first module including a first end portion and a second end portion;

a second module distinct from the first module, the second module including a first end portion and a second end portion, a width of the first end portion of the second module being greater than a width of the second end portion of the second module;

a first male connector disposed at the second end portion of the first module;

a first female connector disposed at the second end portion of the first module;

a second male connector disposed at the second end portion of the second module; and a second female connector disposed at the second end portion of the second module, wherein the first male connector is operable to couple with the second female connector such that the first and second modules are configured to combine to provide a bowtie, and for each of the first and second modules:

the first end portion includes a wide portion spaced away from an end of the first end portion, the first end portion includes a narrow portion disposed between the wide portion and the end of the first portion, a widest width of the wide portion is greater than a width of the narrow portion, and a width of the end of the first end portion is greater than the width of the narrow portion.

12. The bowtie assembly of claim 11, wherein at least one of the first and second male connectors includes a button.

13. The bowtie assembly of claim 11, wherein at least one of the first and second female connectors includes a hole defined through the second end portion of the respective one of the first and second modules.

14. The bowtie assembly of claim 13, wherein at least one of the first and second female connecters includes a plurality of holes defined through the second end portion of the respective one of the first and second modules.

15. The bowtie assembly of claim 13, wherein a first side of the first module includes a first surface design, a second side of the first module includes a second surface design different from the first surface design, a first side of the second module includes the first design, and a second side of the second module includes the second surface design.

16. The bowtie assembly of claim 1, wherein the first end portion of the first module includes a first terminal end of the first module, and the second end portion of the first module includes a second, opposing terminal end of the first module.

17. The bowtie assembly of claim 11, wherein a width of the first end portion of the first module is greater than a width of the second end portion of the first module.

18. The bowtie assembly of claim 17, wherein a width of the first end portion of the second module is greater than a width of the second end portion of the second module.

19. The bowtie assembly of claim 11, wherein the first module is operable to separate from the second module.

* * * * *